US011873653B1

(12) United States Patent
Junnikkala

(10) Patent No.: US 11,873,653 B1
(45) Date of Patent: Jan. 16, 2024

(54) ADJUSTABLE BATTER BOARD

(71) Applicant: Aaron Junnikkala, Kelso, WA (US)

(72) Inventor: Aaron Junnikkala, Kelso, WA (US)

( * ) Notice: Subject to any disclaimer, the term of this patent is extended or adjusted under 35 U.S.C. 154(b) by 781 days.

(21) Appl. No.: 16/998,223

(22) Filed: Aug. 20, 2020

(51) Int. Cl.
*E04G 21/18* (2006.01)

(52) U.S. Cl.
CPC ..... *E04G 21/1816* (2013.01); *E04G 21/1833* (2013.01)

(58) Field of Classification Search
CPC ..... B25B 5/003; B25B 5/10; B25B 5/101; B25B 5/109; E04G 21/1833
See application file for complete search history.

(56) References Cited

U.S. PATENT DOCUMENTS

| | | | | |
|---|---|---|---|---|
| 451,341 | A * | 4/1891 | Stukes | B60C 27/06 24/598.6 |
| 3,861,046 | A * | 1/1975 | Arn | E04G 21/1833 33/405 |
| 3,883,128 | A * | 5/1975 | Breese | B25B 5/006 269/45 |
| 5,657,548 | A | 8/1997 | Kellar, Sr. | |
| 5,778,546 | A | 7/1998 | Williamson | |
| 6,490,803 | B1 | 12/2002 | Butters | |
| 6,817,107 | B1 | 11/2004 | Rabalais, Jr. | |

FOREIGN PATENT DOCUMENTS

CA 2357769 A1 * 3/2003 ..... B25B 5/003

OTHER PUBLICATIONS

Batter Board/Mount Bracket for Lasers. Product Listing [online]. © 2011-2020 Zoro Tools, Inc. [retrieved on Mar. 4, 2020]. Retrieved from the Internet: <URL: https://www.zoro.com/stabila-batter-boardmount-bracket-for-lasers-07410/i/G7039411/feature-product?gclid=Cj0KCQiAwP3yBRCkARIsAABGiPq3RWbPnZUr3uhzmSbCvghZsT_IVDJybTa8kMXOkWZih0RaweYTObUaAliAEALw_wcB>.

Batter Board System. Product Listing [online]. Edge Construction Supply [retrieved on Mar. 4, 2020]. Retrieved from the Internet: <URL: https://www.edgecs.com/products/c/21/anchors/s/241/p/7340/batter-board-system>.

Rousseau 4008 Reusable Batter Board System (8 pack). Product Listing [online]. © 1996-2020, Amazon.com, Inc. [retrieved on Mar. 4, 2020]. Retrieved from the Internet: <URL: https://www.amazon.com/dp/B0006FRAWU/?tag=commentsingpitu77-20>.

* cited by examiner

*Primary Examiner* — Tyrone V Hall, Jr.
(74) *Attorney, Agent, or Firm* — Cramer Patent & Design PLLC; Aaron R. Cramer

(57) ABSTRACT

The adjustable batter board may comprise a first clamp, a second clamp, a hook, and a position adjuster. The adjustable batter board may removably couple to a horizontal crosspiece of a batter board via the first clamp and the second clamp. A string line may be removably coupled to the hook. As a non-limiting example, the string line may designate a layout line of a construction project. The position adjuster may be operable to move the hook laterally in order to position the string line. A plurality of jam nuts may be operable to lock the hook into position.

10 Claims, 4 Drawing Sheets

ADJUSTABLE BATTER BOARD

RELATED APPLICATIONS

None.

FIELD OF THE INVENTION

The present invention relates to a batter board and more specifically to an adjustable batter board.

BACKGROUND OF THE INVENTION

Poured concrete walls, sidewalks, foundations and the like are a common method of building and structure construction. They are relatively easy to build, cost-effective and very long lasting. The construction of such items begins with the installation of batter boards that are placed outside of the formwork area. These boards consist of horizontal braces attached to vertical stakes pounded into the ground. This structure then supports guide strings used to establish a reference point for square and level construction of the concrete formwork.

Alignment of these strings to be perfectly level or with a specified degree of slope is critical to a high-quality job. However, such accuracy is usually performed by pounding attachment nails into the boards and then winding the string around the nail head with whacks to the board as necessary; none of which produces an accurate placement that is easily adjustable. Accordingly, there exists a need for a means by which reference string placement on batter boards can be achieved in a simply and highly accurate manner. The development of the adjustable batter board fulfills this need.

SUMMARY OF THE INVENTION

The principles of the present invention provide for an adjustable batter board consists of a first clamp opening for installation onto and removal from a horizontal crosspiece and closing to grasp the horizontal crosspiece, a second clamp opening for installation onto and removal from a horizontal crosspiece and closing to grasp the horizontal crosspiece, a hook anchoring point for a string line, a position adjuster which is retained on the horizontal crosspiece by the first clamp and the second clamp such that an adjuster screw of the position adjuster is horizontally oriented and parallel to the horizontal crosspiece and a plurality of jam nuts locking the hook into position. The adjustable batter board is removably coupled to the horizontal crosspiece of a batter board via the first clamp and the second clamp. The string line is removably coupled to the hook to serve as a layout line from a construction project. The position adjuster couples to the first clamp via a first adjustment aperture in the body of the first clamp. The position adjuster couples to the second clamp via a second adjustment aperture in the body of the second clamp.

The first clamp may be a C-clamp having a first clamp body and a first clamp adjuster. A first end of the first clamp body terminates at a first fixed jaw and an opposite second end of the first clamp body terminates at a first clamp aperture. The first clamp aperture may be a threaded aperture through which a first clamp screw of the first clamp adjuster passes. The first clamp aperture may be oriented such that a first movable jaw of the first clamp adjuster moves towards or away from the first fixed jaw as the first clamp screw rotates within the first clamp aperture. The first clamp adjuster may include the first clamp screw, the first movable jaw, and a first clamp handle. The first clamp screw may be a threaded shaft.

The first fixed jaw and the first movable jaw present parallel planar surfaces that are brought together by screwing the first clamp screw into the first clamp aperture. The end of the second clamp screw that is opposite the second movable jaw may include the second clamp handle which is operable to rotate the second clamp screw. The second clamp may be a C-clamp having a second clamp body and a second clamp adjuster. A first end of the second clamp body may terminate at a second fixed jaw and an opposite second end of the second clamp body may terminate at a second clamp aperture. The second clamp aperture may be a threaded aperture through which a second clamp screw of the second clamp adjuster passes. The second clamp aperture may be oriented such that a second movable jaw of the second clamp adjuster moves towards or away from the second fixed jaw as the second clamp screw rotates within the second clamp aperture. The second clamp adjuster may include the second clamp screw, the second movable jaw, and a second clamp handle.

The second clamp screw may be a threaded shaft. The second fixed jaw and the second movable jaw present parallel planar surfaces that may be brought together by screwing the second clamp screw into the second clamp aperture. The end of the second clamp screw that is opposite the second movable jaw may include the second clamp handle which may be operable to rotate the second clamp screw. The hook may be a wire armature is shaped into one or more open bends or into a closed loop. The hook includes a collar that may slidably couple to the adjuster screw of the position adjuster. The position adjuster may couple to the second clamp via a second adjustment aperture in the body of the second clamp.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
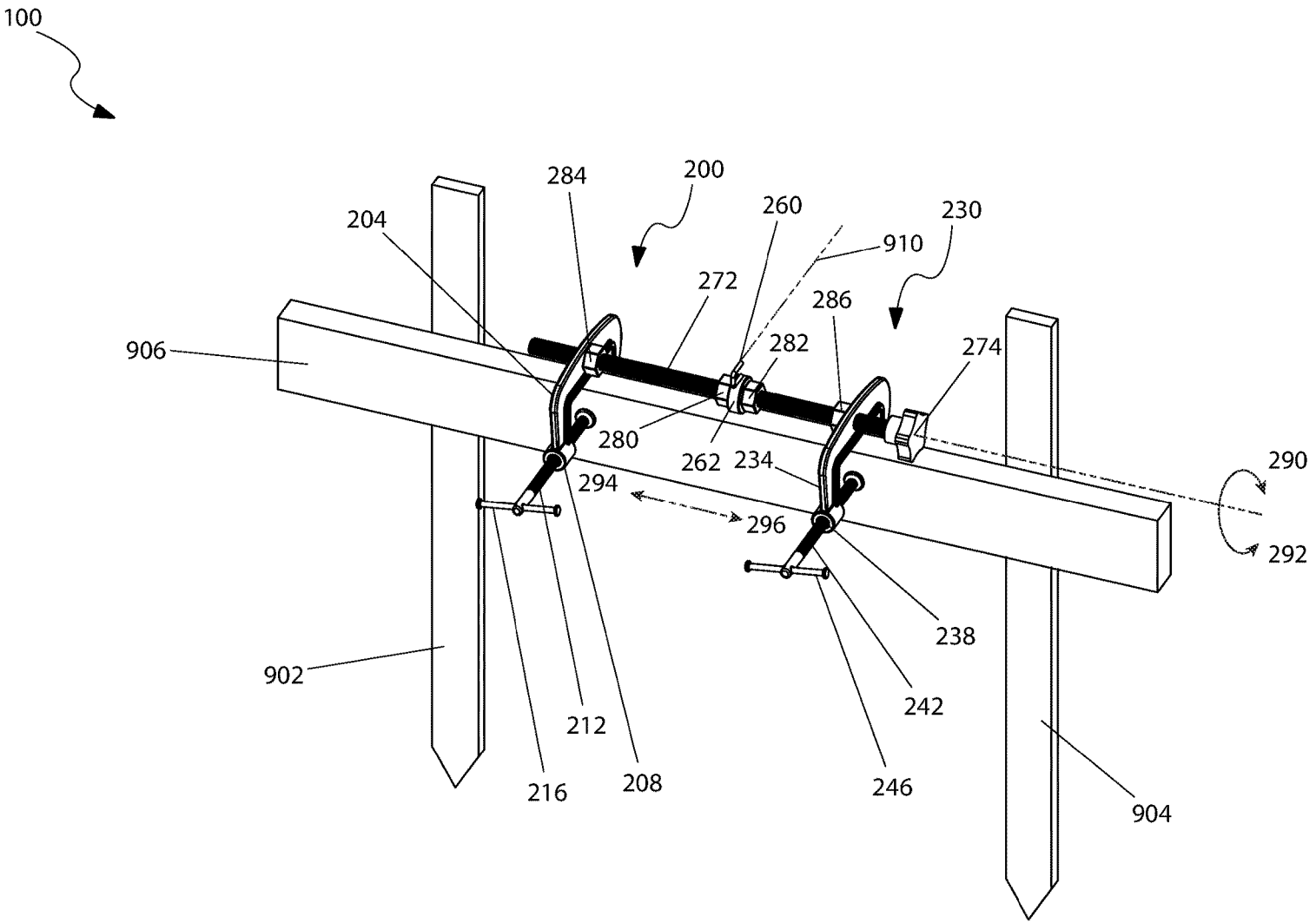
FIG. 1 is an isometric view of an adjustable batter board, according to an embodiment of the present invention, illustrating use of the adjustable batter board.
Figure 2:
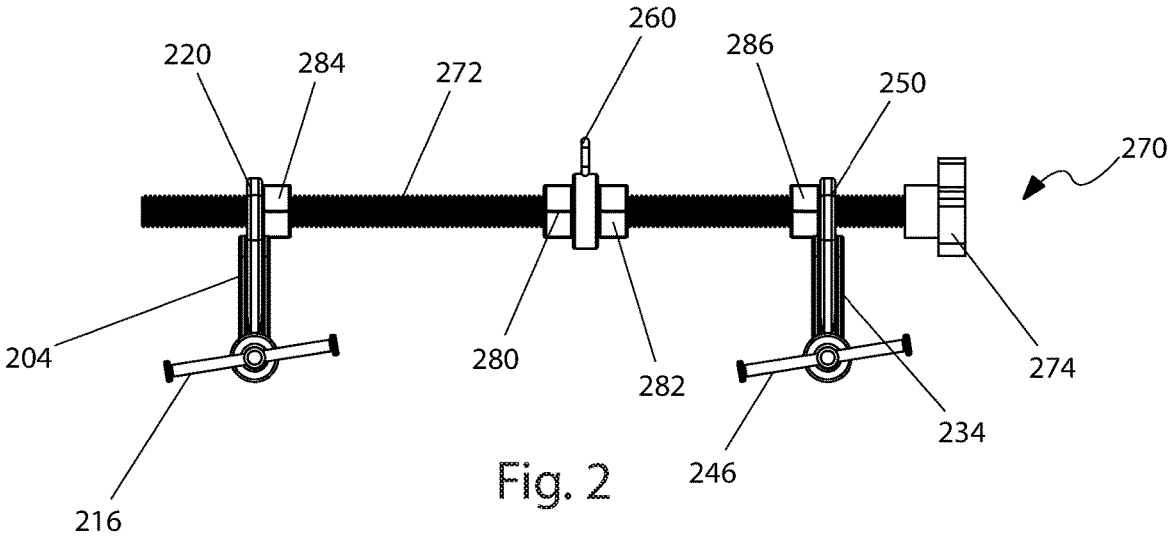
FIG. 2 is a front view of an adjustable batter board, according to an embodiment of the present invention.
Figure 3:
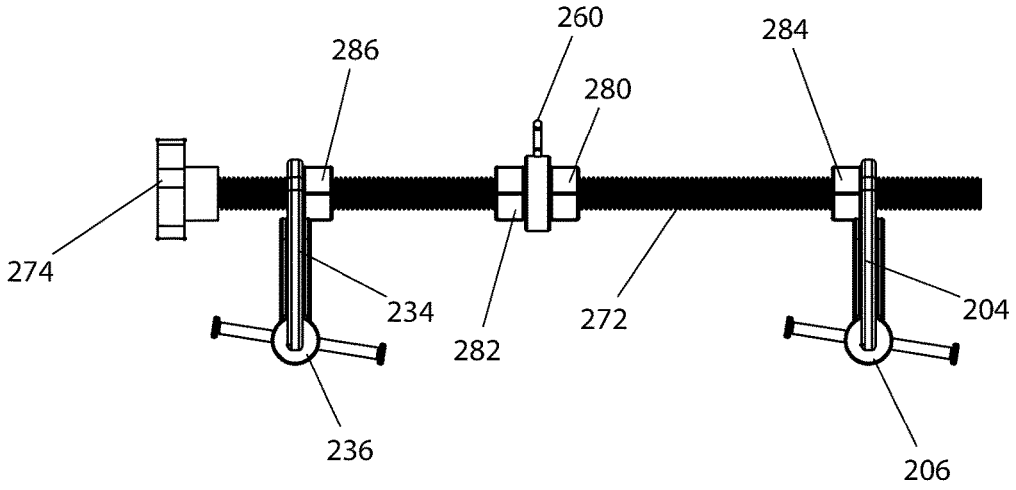
FIG. 3 is a rear view of an adjustable batter board, according to an embodiment of the present invention.
Figure 4:
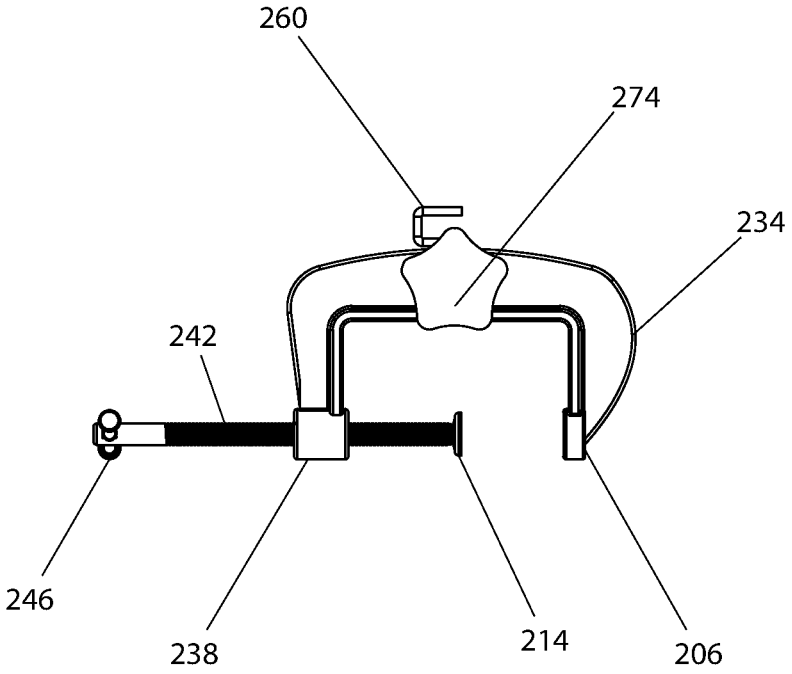
FIG. 4 is a side view of an adjustable batter board, according to an embodiment of the present invention.
Figure 5:
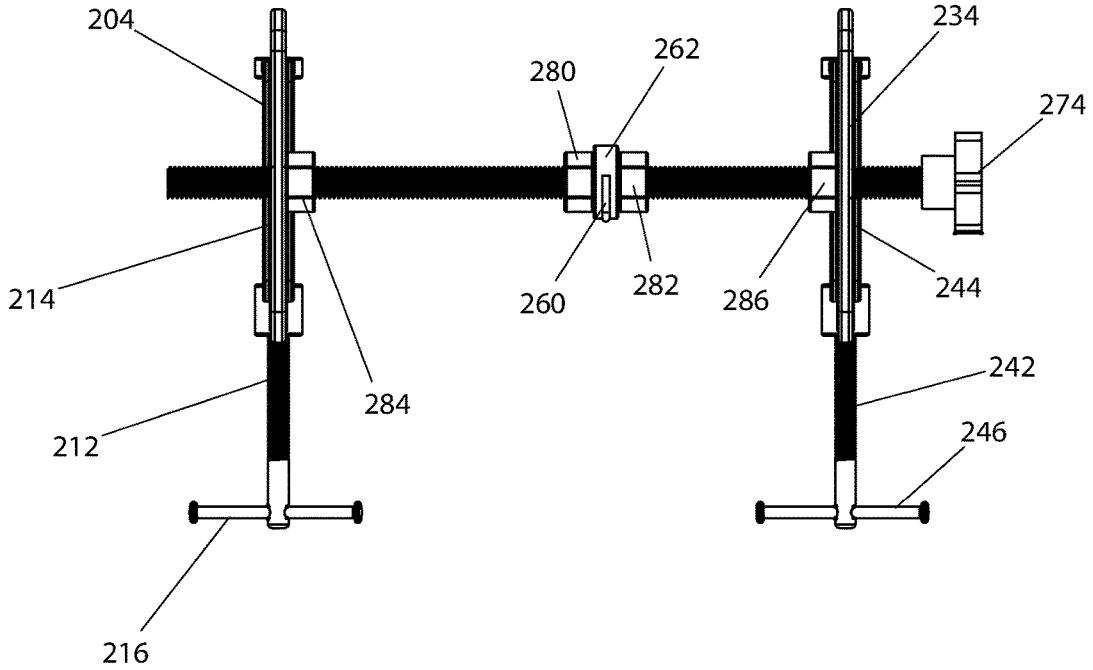
FIG. 5 is a top view of an adjustable batter board, according to an embodiment of the present invention; and, FIG. 6 is a bottom view of an adjustable batter board, according to an embodiment of the present invention.
Figure 6:
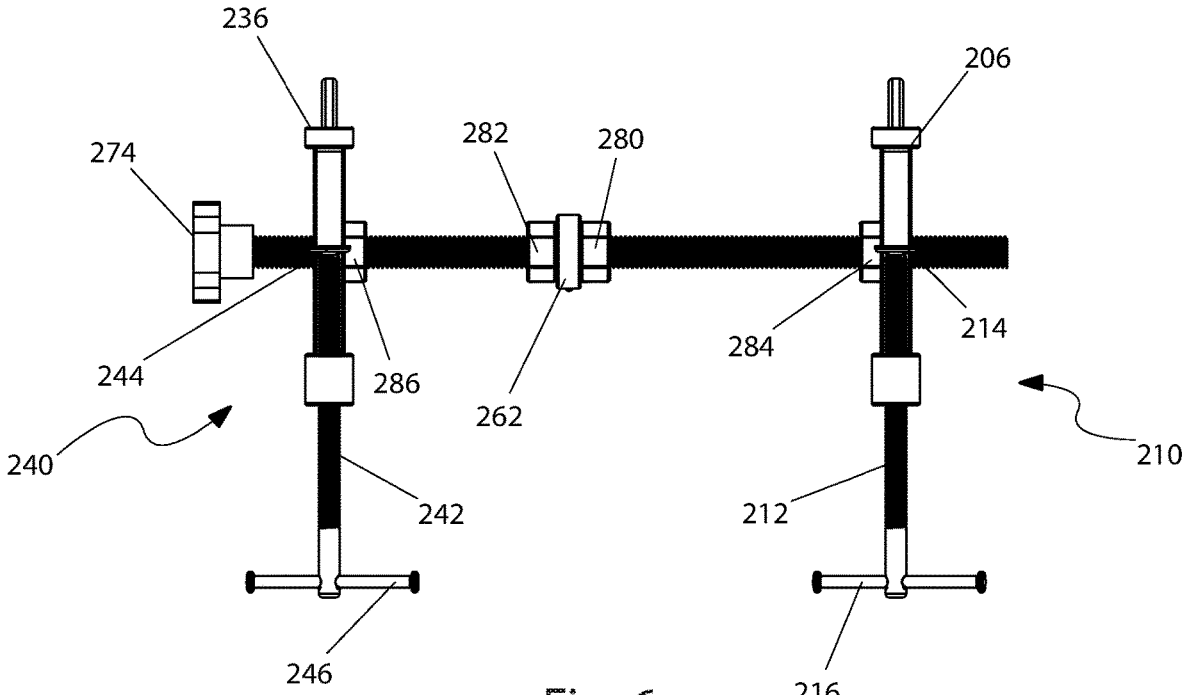

100 adjustable batter board
200 first clamp
202 first c-clamp
204 first clamp body
206 first fixed jaw
208 first clamp aperture
210 first clamp adjuster
212 first clamp screw

214 first movable jaw
216 first clamp handle
220 first adjustment aperture
230 second clamp
232 second c-clamp
234 second clamp body
236 second fixed jaw
238 second clamp aperture
240 second clamp adjuster
242 second clamp screw
244 second movable jaw
246 second clamp handle
250 second adjustment aperture
260 hook
262 collar
270 position adjuster
272 adjuster screw
274 adjuster handle
280 first jam nut
282 second jam nut
284 third jam nut
286 fourth jam nut
288 plurality of jam nuts
290 first rotational direction
292 second rotational direction
294 first linear direction
296 second linear direction
900 batter board
902 first stake
904 second stake
906 horizontal crosspiece
910 string line

DESCRIPTION OF THE INVENTION

The present invention is directed to an adjustable batter board (herein described as the "invention") 100. The invention 100 may comprise a first clamp 200, a 10 second clamp 230, a hook 260, and a position adjuster 270. The invention 100 may removably couple to a horizontal crosspiece 906 of a batter board 900 via the first clamp 200 and the second clamp 230. A string line 910 may be removably coupled to the hook 260. As a non-limiting example, the string line 910 may designate a layout line of a construction project. The position adjuster 270 may be operable to move the hook 260 laterally in order to position the string line 910. A plurality of jam nuts 288 may be operable to lock the hook 260 into position.

In the prior art, a nail might be driven into the horizontal crosspiece 906 of the batter board 900 and the string line 910 tied off on the nail. If the string line 910 is found to be incorrectly positioned by even a slight amount, the nail is pulled and driven into the horizontal crosspiece 906 at a new location, leaving a hole in the horizontal crosspiece 906 each time the nail is driven into the horizontal crosspiece 906. Benefits of using the invention 100 over the prior art may include less confusion because a plethora of nail holes are not left in the horizontal crosspiece 906 and less time to square up a grid for the construction project because nails do not have to be pulled and rehammered to make an adjustment to the position of the string line 910.

The first clamp 200 and the second clamp 230 may retain the position adjuster 270 on the horizontal crosspiece 906 of the batter board 900 such that an adjuster screw 272 of the position adjuster 270 is horizontally oriented and parallel to the horizontal crosspiece 906. The first clamp 200 and the second clamp 230 may open for installation onto and removal from the horizontal crosspiece 906. The first clamp 200 and the second clamp 230 may close to grasp the horizontal crosspiece 906. The position adjuster 270 may couple to the first clamp 200 via a first adjustment aperture 220 which may be a threaded aperture in the body of the first clamp 200. The position adjuster 270 may couple to the second clamp 230 via a second adjustment aperture 250 which may be a threaded aperture in the body of the second clamp 230.

As non-limiting examples, the first clamp 200 may be a first c-clamp 202 and the second clamp 230 may be a second c-clamp 232. The first c-clamp 202 may comprise a first clamp body 204 and a first clamp adjuster 210. The first clamp body 204 may be a C-shaped armature. One (1) end of the first clamp body 204 may terminate at a first fixed jaw 206. The opposite end of the first clamp body 204 may terminate at a first clamp aperture 208. The first clamp aperture 208 may be a threaded aperture through which a first clamp screw 212 of the first clamp adjuster 210 passes. The first clamp aperture 208 may be oriented such that a first movable jaw 214 of the first clamp adjuster 210 moves towards or away from the first fixed jaw 206 as the first clamp screw 212 rotates within the first clamp aperture 208.

The first clamp adjuster 210 may comprise the first clamp screw 212, the first movable jaw 214, and a first clamp handle 216. The first clamp screw 212 may be a threaded shaft. The diameter and thread attributes of the first clamp screw 212 may be complementary to the diameter and thread attributes of the first clamp aperture 208 such that the first clamp screw 212 may rotate within the first clamp aperture 208. The end of the first clamp screw 212 that is nearest the first fixed jaw 206 may be terminated by the first movable jaw 214. The first fixed jaw 206 and the first movable jaw 214 may present parallel planar surfaces that may be brought together by screwing the first clamp screw 212 into the first clamp aperture 208. The end of the first clamp screw 212 that is opposite the first movable jaw 214 may comprise the first clamp handle 216. The first clamp handle 216 may be operable to rotate the first clamp screw 212. In some embodiments, the first movable jaw 214 may pivot on the end of the first clamp screw 212 such that tightening the first clamp screw 212 while the first movable jaw 214 is against an object does not cause the first movable jaw 214 to move across the surface of the object.

The second c-clamp 232 may comprise a second clamp body 234 and a second clamp adjuster 240. The second clamp body 234 may be a C-shaped armature. One (1) end of the second clamp body 234 may terminate at a second fixed jaw 236. The opposite end of the second clamp body 234 may terminate at a second clamp aperture 238. The second clamp aperture 238 may be a threaded aperture through which a second clamp screw 242 of the second clamp adjuster 240 passes. The second clamp aperture 238 may be oriented such that a second movable jaw 244 of the second clamp adjuster 240 moves towards or away from the second fixed jaw 236 as the second clamp screw 242 rotates within the second clamp aperture 238.

The second clamp adjuster 240 may comprise the second clamp screw 242, the second movable jaw 244, and a second clamp handle 246. The second clamp screw 242 may be a threaded shaft. The diameter and thread attributes of the second clamp screw 242 may be complementary to the diameter and thread attributes of the second clamp aperture 238 such that the second clamp screw 242 may rotate within the second clamp aperture 238. The end of the second clamp screw 242 that is nearest the second fixed jaw 236 may be terminated by the second movable jaw 244. The second fixed jaw 236 and the second movable jaw 244 may present parallel planar surfaces that may be brought together by screwing the second clamp screw 242 into the second clamp aperture 238. The end of the second clamp screw 242 that is opposite the second movable jaw 244 may comprise the second clamp handle 246. The second clamp handle 246 may be operable to rotate the second clamp screw 242. In some embodiments, the second movable jaw 244 may pivot on the end of the second clamp screw 242 such that tightening the second clamp screw 242 while the second movable jaw 244 is against an object does not cause the second movable jaw 244 to move across the surface of the object.

The hook 260 may be an anchoring point for the string line 910. As non-limiting examples, the hook 260 may be a wire armature in the shape of one or more open bends or in the shape of a closed loop. The hook 260 may comprise a collar 262. The collar 262 may slidably couple to the adjuster screw 272 of the position adjuster 270.

The position adjuster 270 may be operable to move the collar 262 bearing the hook 260 laterally between the first clamp 200 and the second clamp 230. The position adjuster 270 may comprise the adjuster screw 272, a first jam nut 280, a second jam nut 282, a third jam nut 284, and a fourth jam nut 286. The hook 260 may be manually position by loosening the first jam nut 280 and the second jam nut 282 and by sliding the collar 262. The collar 262 may be retained by tightening the first jam nut 280 and the second jam nut 282 against the collar 262. The hook 260 may be repositioned by loosening the third jam nut 284 and the fourth jam nut 286 and turning the adjuster screw 272 via an adjuster handle 274. As the adjuster screw 272 is turned, the adjuster screw 272 may rotate within the first jam nut 280, the second jam nut 282, and the collar 262 causing the first jam nut 280, the second jam nut 282, and the collar 262 to travel along the adjuster screw 272. The direction of travel may be changed by reversing the rotational direction of the adjuster screw 272.

The diameter and thread attributes of the first jam nut 280, the second jam nut 282, the third jam nut 284, and the fourth jam nut 286 may be complementary to the diameter and thread attributes of the adjuster screw 272 such that the adjuster screw 272 may rotate within the first jam nut 280, the second jam nut 282, the third jam nut 284, and the fourth jam nut 286.

The adjuster screw 272 may be a threaded shaft that is threadedly coupled to the first clamp 200 and to the second clamp 230. The adjuster screw 272 may comprise the adjuster handle 274 located at one end of the adjuster screw 272. The adjuster handle 274 may be rotated to turn the adjuster screw 272, resulting in lateral movement of the collar 262 and the hook 260. The diameter and thread attributes of the adjuster screw 272 may be complementary to the diameter and thread attributes of the first adjustment aperture 220 on the first clamp 200 and to the second adjustment aperture 250 on the second clamp 230 such that the adjuster screw 272 may rotate within the first adjustment aperture 220 and the second adjustment aperture 250 a string line removably coupled to the hook to serve as a layout line from a construction project.

The adjuster screw 272 may pass through the first jam nut 280, the second jam nut 282, the third jam nut 284, and the fourth jam nut 286. An individual jam nut selected from the first jam nut 280, the second jam nut 282, the third jam nut 284, and the fourth jam nut 286 may be rotated in a first rotational direction 290 causing the individual jam nut to move along the adjuster screw 272 in a first linear direction 294. The individual jam nut may be rotated in a second rotational direction 292 causing the individual jam nut to move along the adjuster screw 272 in a second linear direction 296.

The first jam nut 280 and the second jam nut 282 may be located on either side of the collar 262. The first jam nut 280 may be turned in the first rotational direction 290 and the second jam nut 282 may be turned in the second rotational direction 292 to move the first jam nut 280 and the second jam nut 282 away from the collar 262 such that the collar 262 may freely slide laterally along the adjuster screw 272 between the first jam nut 280 and the second jam nut 282. The first jam nut 280 may be turned in the second rotational direction 292 and the second jam nut 282 may be turned in the first rotational direction 290 to move the first jam nut 280 and the second jam nut 282 against the collar 262 such that the collar 262 may be retained at a fixed location between the first jam nut 280 and the second jam nut 282.

The third jam nut 284 may be located between the first clamp 200 and the first jam nut 280. The fourth jam nut 286 may be located between the second clamp 230 and the second jam nut 282. The third jam nut 284 may be turned in the first rotational direction 290 to move the third jam nut 284 against the first clamp 200 and the fourth jam nut 286 may be turned in the second rotational direction 292 to move the fourth jam nut 286 against the second clamp 230 such that the third jam nut 284 and the fourth jam nut 286 may prevent the adjuster screw 272 from rotating. The third jam nut 284 may be turned in the second rotational direction 292 to move the third jam nut 284 away from the first clamp 200 and the fourth jam nut 286 may be turned in the first rotational direction 290 to move the fourth jam nut 286 away from the second clamp 230 such that the adjuster screw 272 may freely rotate.

In use, the batter board 900 may be coarsely positioned adjacent to a corner of a construction project. As a non-limiting example, the batter board 900 may be constructed by driving a first stake 902 and a second stake 904 into the ground and coupling the horizontal crosspiece 906 to the stakes. The invention 100 may be coupled to the batter board 900 using the first clamp 200 and the second clamp 230 such that the adjuster screw 272 is horizontally oriented above the horizontal crosspiece 906 and is parallel to the horizontal crosspiece 906. The string line 910 may be coupled to the hook 260. The first jam nut 280 and the second jam nut 282 may be rotated to move the first jam nut 280 and the second jam nut 282 away from the collar 262. The hook 260 may be moved by sliding the collar 262 on the adjuster screw 272 such that the string line 910 coarsely aligns with a corner of the construction project. The first jam nut 280 and the second jam nut 282 may be tightened against the collar 262 to retain the collar 262. The third jam nut 284 and the fourth jam nut 286 may be rotated to move the third jam nut 284 away from the first clamp 200 and to move the fourth jam nut 286 away from the second clamp 230. The adjuster handle 274 may be turned to more precisely position the hook 260. As the adjuster handle 274 is rotated, the adjuster screw 272 may turn and may cause the first jam nut 280, the second jam nut 282 and the collar 262 to move in the first linear direction 294 or the second linear direction 296. The direction of travel of the hook 260 may be reversed by turning the adjuster handle 274 in the opposite rotational direction. When the string line 910 is precisely above the corner of the construction project, the third jam nut 284 and the fourth jam nut 286 may be tightened against the first clamp 200 and the second clamp 230, respectively.

What is claimed is:

1. An adjustable batter board, comprising:

a first clamp opening for installation onto and removal from a horizontal crosspiece and closing to grasp the horizontal crosspiece;

a second clamp opening for installation onto and removal from a horizontal crosspiece and closing to grasp the horizontal crosspiece;

a hook anchoring point for a string line;

a position adjuster retained on the horizontal crosspiece by the first clamp and the second clamp such that an adjuster screw of the position adjuster is horizontally oriented and parallel to the horizontal crosspiece;

a plurality of jam nuts locking the hook into position;

wherein the adjustable batter board is removably coupled to the horizontal crosspiece of a batter board via the first clamp and the second clamp;

wherein the string line is removably coupled to the hook to serve as a layout line from a construction project;

wherein the position adjuster couples to the first clamp via a first adjustment aperture in the body of the first clamp;

wherein the position adjuster couples to the second clamp via a second adjustment aperture in the body of the second clamp;

wherein a first end of the second clamp body terminates at a second fixed jaw and an opposite second end of the second clamp body terminates at a second clamp aperture;

wherein the second clamp aperture is a threaded aperture through which a second clamp screw of the second clamp adjuster passes;

wherein the second clamp aperture is oriented such that a second movable jaw of the second clamp adjuster moves towards or away from the second fixed jaw as the second clamp screw rotates within the second clamp aperture;

wherein the second clamp adjuster includes the second clamp screw, the second movable jaw, and a second clamp handle;

wherein the second clamp screw is a threaded shaft;

wherein the second fixed jaw and the second movable jaw present parallel planar surfaces that are brought together by screwing the second clamp screw into the second clamp aperture;

wherein an end of the second clamp screw that is opposite the second movable jaw includes the second clamp handle which is operable to rotate the second clamp screw;

wherein the hook is a wire armature is shaped into one or more open bends or into a closed loop;

wherein the hook includes a collar that slidably couples to the adjuster screw of the position adjuster; and, wherein the position adjuster couples to the second clamp via a second adjustment aperture in the body of the second clamp.

2. The adjustable batter board, according to claim 1, wherein the first clamp is a C-clamp having a first clamp body and a first clamp adjuster.

3. The adjustable batter board, according to claim 2, wherein a first end of the first clamp body terminates at a first fixed jaw and an opposite second end of the first clamp body terminates at a first clamp aperture.

4. The adjustable batter board, according to claim 3, wherein the first clamp aperture is a threaded aperture through which a first clamp screw of the first clamp adjuster passes.

5. The adjustable batter board, according to claim 3, wherein the first clamp aperture is oriented such that a first movable jaw of the first clamp adjuster moves towards or away from the first fixed jaw as the first clamp screw rotates within the first clamp aperture.

6. The adjustable batter board, according to claim 3, wherein the first clamp adjuster includes the first clamp screw, the first movable jaw, and a first clamp handle.

7. The adjustable batter board, according to claim 3, wherein the first clamp screw is a threaded shaft.

8. The adjustable batter board, according to claim 3, wherein the first fixed jaw and the first movable jaw present parallel planar surfaces that are brought together by screwing the first clamp screw into the first clamp aperture.

9. The adjustable batter board, according to claim 3, wherein an end of the second clamp screw that is opposite the second movable jaw includes the second clamp handle which is operable to rotate the second clamp screw.

10. The adjustable batter board, according to claim 1, wherein the second clamp is a C-clamp having a second clamp body and a second clamp adjuster.

* * * * *